US005532545A

United States Patent [19]

Okamoto et al.

[11] Patent Number: 5,532,545

[45] Date of Patent: Jul. 2, 1996

[54] COLOR CATHODE RAY TUBE

[75] Inventors: Takami Okamoto, Muko; Hideaki Maki, Sakai; Osamu Konosu, Nagaokakyo, all of Japan

[73] Assignee: Matsushita Electronics Corporation, Osaka, Japan

[21] Appl. No.: 243,579

[22] Filed: May 16, 1994

[30] Foreign Application Priority Data

May 19, 1993 [JP] Japan ..... 5-116983

[51] Int. Cl.[6] ..... H01J 29/80

[52] U.S. Cl. ..... 313/407; 313/402; 313/404; 313/405

[58] Field of Search ..... 348/816, 817, 348/824; 313/402, 404, 405, 407

[56] References Cited

U.S. PATENT DOCUMENTS

| | | | |
|---|---|---|---|
| 4,332,329 | 6/1982 | Scriven et al. . | |
| 4,644,222 | 2/1987 | Brunn | 313/302 |
| 4,730,143 | 3/1988 | Fendley | 313/407 |
| 4,739,412 | 4/1988 | Lee | 358/247 |
| 4,839,736 | 6/1989 | Sugihara | 358/253 |
| 4,937,493 | 6/1990 | Koike | 313/479 |
| 4,943,862 | 7/1990 | Uesaka | 358/245 |
| 5,072,301 | 12/1991 | Dziedzic . | |
| 5,216,321 | 6/1993 | Kawamura et al. . | |
| 5,348,825 | 9/1994 | Nakamura | 430/5 |

FOREIGN PATENT DOCUMENTS

| | | |
|---|---|---|
| 0255958 | 2/1988 | European Pat. Off. . |
| 0298582 | 1/1989 | European Pat. Off. . |
| 0396189 | 11/1990 | European Pat. Off. . |
| 1422249 | 11/1968 | Germany . |
| 52-87353 | 7/1977 | Japan . |
| 2-148544 | 6/1990 | Japan . |
| 2228364 | 8/1990 | United Kingdom . |

OTHER PUBLICATIONS

European Search Report dated Jul. 28, 1995.

European Search Report dated Aug. 29, 1994 for corresponding European patent application No. EP 94 10 7622.

*Primary Examiner*—Sandra L. O'Shea

*Assistant Examiner*—John Ning

*Attorney, Agent, or Firm*—Ratner & Prestia

[57] ABSTRACT

In the bulb of a color cathode ray tube, a flat glass panel having a substantially uniform thickness is used. The flat glass panel has a glass wall which extends in a substantially vertical direction from the flat glass panel. The glass wall adheres to a funnel, which includes a neck portion in which an electron gun is disposed, by means of a glass adhesive so as to form the bulb. A shadow mask on which a number of apertures are formed is fixed to a frame with an appropriate tensile stress and the frame is mounted on the glass wall. The shadow mask is disposed at a position close to the phosphor screen formed on the inner surface of the flat glass panel, facing thereto. On the outer surface of the flat glass panel, a resin film comprising at least one layer is attached by means of an adhesive. The resin film has appropriate mechanical, optical and electrical properties with which the flat glass panel should have. Thus, various properties of the flat glass panel can be controlled. As a result, it makes it possible to provide a high performance color cathode ray tube using a thin flat glass panel which has a sufficiently large mechanical strength and desirable optical characteristics, capable of displaying images with high resolution and high color tone without distortion over the entire front surface.

19 Claims, 4 Drawing Sheets

COLOR CATHODE RAY TUBE

BACKGROUND OF THE INVENTION

1. Field of the Invention

The present invention relates to a color cathode ray tube used for home television sets, computer monitors, and the like.

2. Description of the Related Art

A color cathode ray tube (hereinafter referred to as a color CRT) has been broadly used for a variety of home and industrial apparatuses including television sets and computer monitors. An enhanced quality of images is always requested for such a color CRT. Especially, in recent years, there has been a strong need to realize a color CRT capable of producing images with high resolution and high color tone without distortion over the entire front surface of the color CRT.

Conventionally, a color CRT includes a glass bulb (hereinafter referred to as a bulb). The bulb has a curved panel made of glass (hereinafter referred to as a curved panel) and a phosphor screen is formed on the inner surface of the curved panel for emitting three colors, i.e., red, green, and blue. The bulb also includes a funnel which is attached to the curved panel by means of a glass adhesive so as to form the bulb. The inside of the bulb is in a high vacuum condition.

A curved shadow mask with a thickness of 0.1 to 0.3 mm having a number of apertures formed therethrough is disposed at a position close to the inner surface of the curved panel, facing thereto. The shadow mask is secured to a metal frame disposed inside the bulb so as to follow the curved profile of the inner surface of the curved panel.

The funnel includes a neck portion in the rear thereof where an electron gun is disposed for emitting electron beams. The electron beams emitted from the electron gun pass through the apertures of the shadow mask to reach the phosphor screen on the inner surface of the curved panel, allowing the phosphor screen to emit light.

If the distance between the shadow mask and the phosphor screen changes, the color tone of images produced on the phosphor screen also changes, resulting in a deterioration of the quality of the images. Accordingly, in order to obtain stable operating properties of the color CRT, the distance between the shadow mask and the phosphor screen should be kept constant irrespective of any change in the environmental conditions. However, in the above conventional color CRT where both the shadow mask and the phosphor screen are curved, it is difficult to precisely control the distance between two curved surfaces.

In general, only approximately 20% of the total emission of electron beams output from the electron gun are actually incident to the phosphor screen. The remaining electron beams are absorbed by the shadow mask, causing an increase in the temperature of the shadow mask and thus an expansion thereof. In the conventional color CRT where the shadow mask is curved along the curved profile of the inner surface of the curved panel, the shadow mask becomes deformed due to the thermal expansion so that it becomes closer to the inner surface of the curved panel, in other words, the phosphor screen formed thereon. As a result, the resultant images produced on the screen become deteriorated because of the expansion.

In order to obtain images with high resolution and high color tone, the shadow mask should be thin, and the pitch of the apertures formed in the shadow mask should be small. In the conventional color CRT having a curved profile, it is difficult to reduce the thickness of the shadow mask beyond a certain level because below such a level, a sufficiently large mechanical strength will not be obtained.

Further, in general, the pitch of the apertures formed on the shadow mask should be twice the diameter of the apertures so as to avoid mis-landing the electron beams on the phosphor screen. Also, in order to secure the process accuracy, the minimum diameter of the apertures should be at least four fifths of the thickness of the shadow mask. Under these limitations, it is difficult with the conventional curved shadow mask to decrease the pitch of the apertures to 0.2 mm or less so as to obtain images with high resolution and high color tone.

In order to overcome the above mentioned problems, a flat panel made of glass (hereinafter referred to as the flat panel) may be used instead of the curved panel. However, such a conventional panel has the following disadvantages.

The flat panel needs to be thick enough to resist a significantly large pressure difference between the inside and the outside of the bulb caused by the high vacuum so as to prevent the bulb from breaking. As the flat panel becomes thicker, the distortion of the images produced on the phosphor screen becomes greater due to the deflection of light through the glass. In some cases, only the outer surface of the conventional panel is made flat, although the inner surface of the conventional flat panel remains curved. This brings a non-uniform thickness of the flat panel and consequent difference of intensity of the transmitting light between the center portion of the flat panel and the peripheral portion thereof, resulting in a nonuniform luminance distribution of the images. Besides the above optical disadvantages, such a thick flat panel is disadvantageous in that the resultant color CRT becomes heavier.

As described above, the conventional flat panel fails in realizing a color CRT with high performance which can completely replace the aforementioned conventional color CRT having the curved panel.

SUMMARY OF THE INVENTION

The color cathode ray tube of this invention comprises: a bulb having a flat glass panel; and a flat shadow mask provided inside the bulb, the flat shadow mask facing the flat glass panel, wherein a resin film comprising at least one layer is attached to the outer surface of the flat glass panel.

Preferably, the flat glass panel further comprises a glass wall formed integrally as a part of the flat glass panel, the glass wall extending in a substantially vertical direction from the flat glass panel.

In one embodiment, the color cathode ray tube of this invention further comprises a frame attached to the glass wall inside the bulb, the frame supporting the flat shadow mask. Preferably, the frame gives the shadow mask tensile stress at least at room temperature. The frame may be attached so as to be capable of being repeatedly removed and mounted from/to the glass wall.

In another embodiment, the thickness of the flat shadow mask is set in a range of 0.01 mm to 0.2 mm.

In still another embodiment, the flat glass panel has a predetermined thickness which is substantially uniform. Preferably, the predetermined thickness of the flat glass panel is in a range from 5 mm to 20 mm.

In still another embodiment, at least one layer of the resin film functions as a conductive layer which has a sufficient level of electrical conductivity so as to prevent the flat glass panel from being electrified. Preferably, the conductive layer has an electrical conductivity which is in a range from $1\times10^{-6}$ S/cm to 1 S/cm.

In still another embodiment, at least one layer of the resin film is diffused with additives so as to control light transmittance of the flat glass panel and the resin film. Preferably, a light transmittance of the resin film is adjusted so that the light transmittance of the flat glass panel and the resin film as a whole is in a range from 40% to 90%.

In still another embodiment, at least one layer of the resin film is a non-reflection layer for preventing the reflection of light incident from the outside of the bulb. Alternatively, on a surface of the resin film, convex and concave portions may be formed so as to prevent the reflection of light incident from the outside of the bulb. Preferably, a light reflectance of the surface of the resin film is set to be in a range from 1% to 95%.

In still another embodiment, a surface of the resin film is reformed so as to increase a hardness of the surface of the resin film. Alternatively, on a surface of the resin film, a high-hardness film having a higher hardness than that of other portions of the resin film may be formed so as to increase a hardness of the surface of the resin film. Preferably, the hardness of the surface of the resin film is set to be in a range from H to 9H in pencil hardness.

In still another embodiment, the color cathode ray tube of this invention further comprises a reinforcing band surrounding the circumference of the glass wall of the bulb.

In still another embodiment, at least one layer of the resin film is made of a material selected from a group consisting of polyethylene, polyethylene terephthalate, polystyrene and polyester.

In still another embodiment, the resin film comprises: a resin sheet in which additives are diffused; a non-reflection film formed on a surface of the resin sheet so as to prevent the reflection of light incident from the outside of the bulb; and a conductive film formed on the other surface of the resin sheet, the conductive film having a sufficient level of an electrical conductivity so as to prevent the flat glass panel from being electrified, and wherein the resin film is attached to the flat glass panel by an adhesive applied on the conductive film.

In still another embodiment, the resin film comprises: a resin sheet in which additives are diffused; a high-hardness film having a higher hardness than that of the resin sheet, the high-hardness film formed on a surface of the resin sheet so as to increase a hardness of the surface of the resin sheet, the high-hardness film having convex and concave portions formed on a surface thereof so as to prevent the reflection of light incident from the outside of the bulb; and a conductive film formed on the other surface of the resin sheet, the conductive film having a sufficient level of an electrical conductivity so as to prevent the flat glass panel from being electrified, and wherein the resin film is attached to the flat glass panel by an adhesive applied on the conductive film.

Thus, the invention described herein makes possible the advantages of (1) providing a color CRT using a thin flat glass panel having a sufficiently strong mechanical strength and desirable optical characteristics, (2) providing a color CRT with high performance capable of displaying images with high resolution and high color tone without distortion over the entire front surface, and (3) providing a color CRT capable of easily adjusting to the various characteristics of a glass panel.

These and other advantages of the present invention will become apparent to those skilled in the art upon reading and understanding the following detailed description with reference to the accompanying figures.

DESCRIPTION OF THE PREFERRED EMBODIMENTS

The present invention will be described by way of example with reference to the attached drawings as follows.

Figure 1:
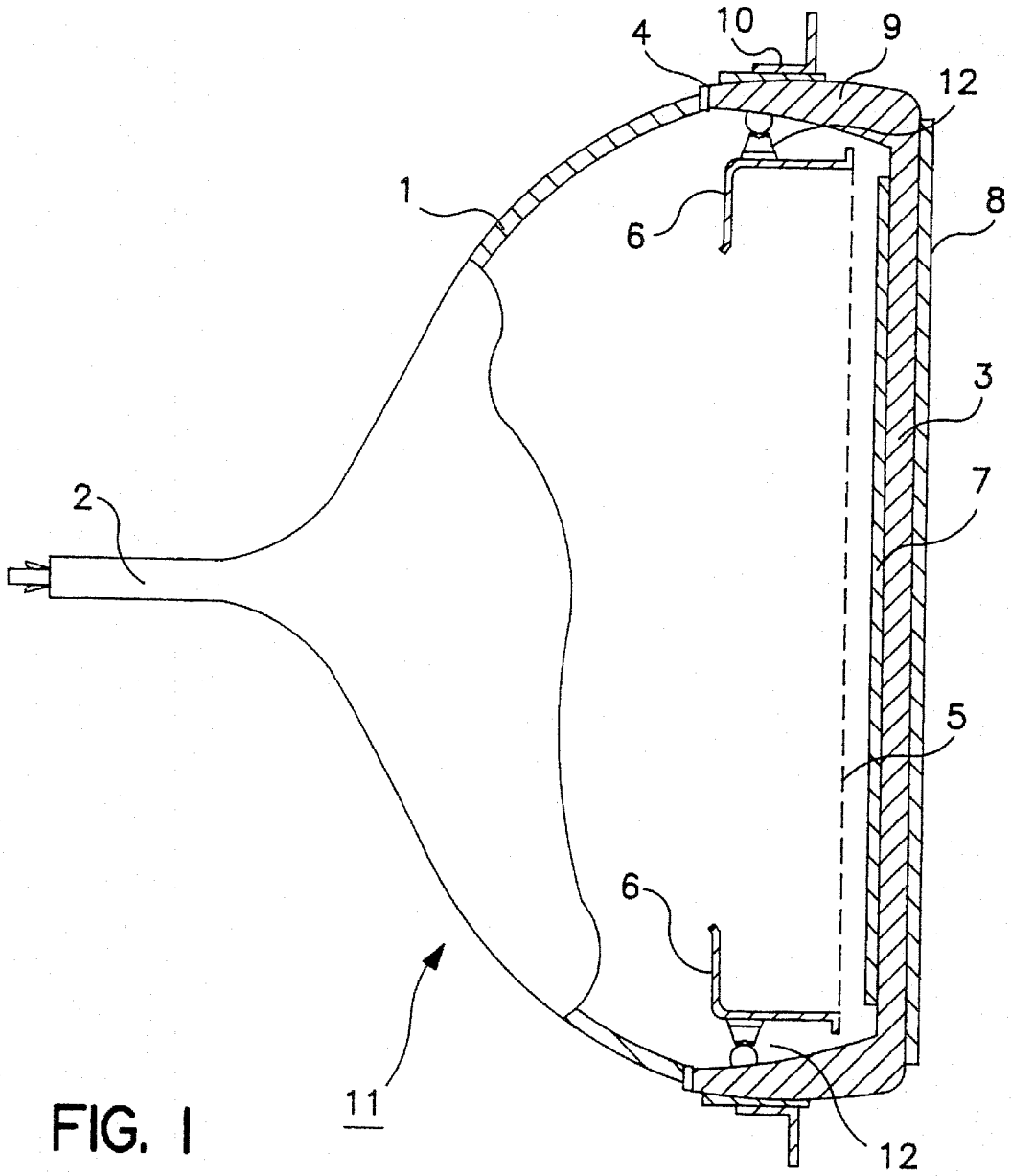
FIG. 1 is a schematic sectional view of a color CRT according to the present invention.

FIG. 1 schematically shows a section of a color CRT according to the present invention. Referring to FIG. 1, the color CRT includes a bulb 11 having a flat panel 3 made of glass with a substantially uniform thickness. The bulb 11 also has a funnel 1 including a neck portion 2 in the rear thereof. An electron gun (not shown) is disposed in the neck portion 2.

A glass wall 9 is formed integrally as a part of the flat panel 3 around the periphery thereof. The glass wall 9 extends substantially vertically from the flat panel 3 and is fastened to the funnel 1 by means of a glass adhesive 4. Thus, the structure of the bulb 11 having the flat panel 3 and the funnel 1 connected with each other is completed.

The glass wall 9 contributes to improving the strength of the bulb 11. More specifically, without the glass wall 9, a large amount of stress will be produced at or near the connecting portion between the flat panel 3 and the funnel 1 when a force toward the left as seen in FIG. 1 is applied to the flat panel 3. This may results in breaks of the bulb 11 (especially at the end of the funnel 1). The glass wall 9 of this example absorbs stress, preventing the occurrence of such breaks. The strength of the bulb 11 is further improved by disposing a reinforcing metallic band 10 around the circumference of the glass wall 9.

The angle between the glass wall 9 and the flat panel 3 is not necessarily strictly 90°. The shape, the size, and other requirements of the-glass wall 9 may be arbitrarily determined insofar as the bulb 11 has the necessary strength.

Figure 2:
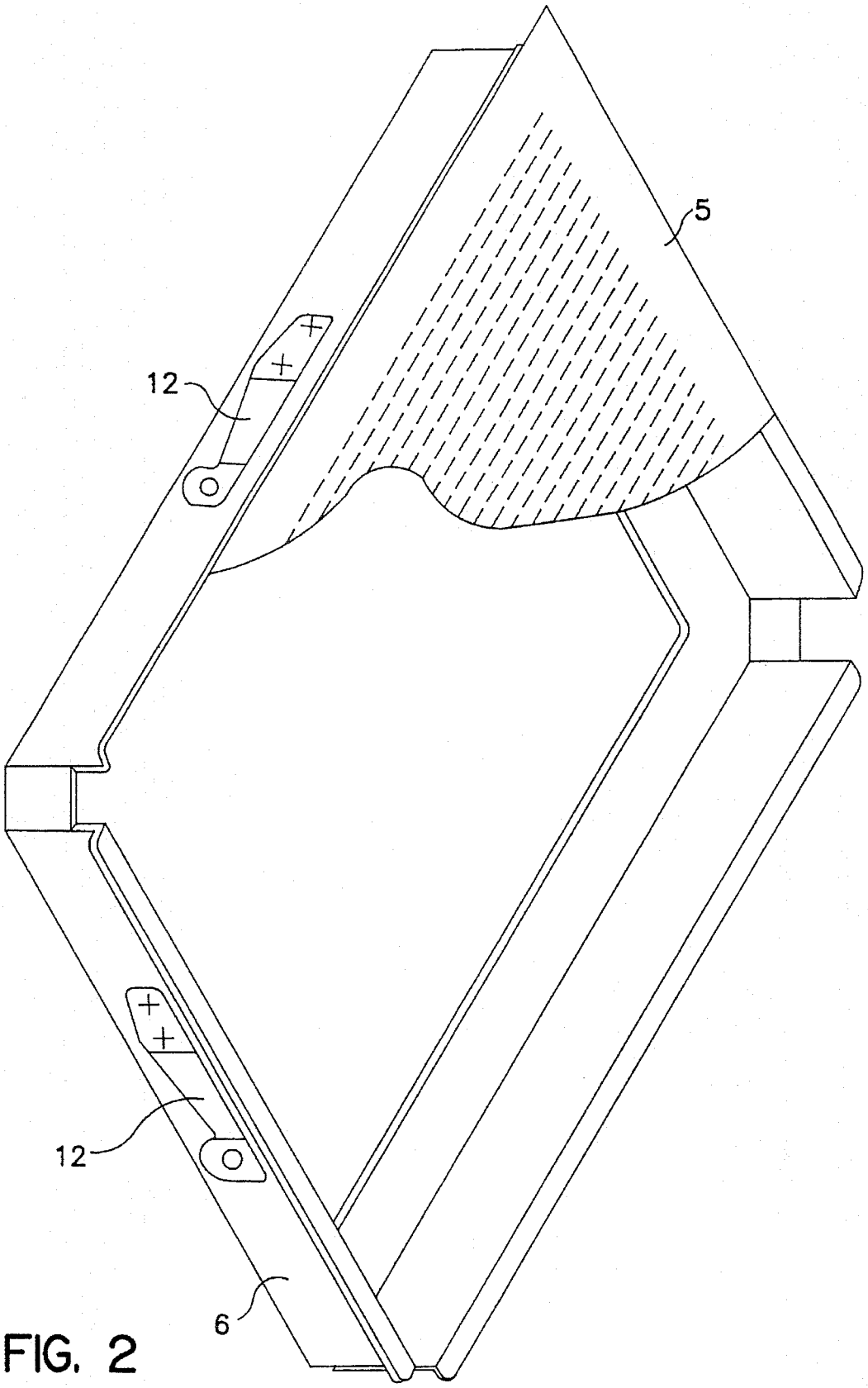
FIG. 2 is a schematic perspective view of a frame and a shadow mask used for the color CRT according to the present invention.

A frame 6 is secured to the inner surface of the glass wall 9 through a mask spring 12. A flat shadow mask 5 is supported by the frame 6 so as to stand straight along the flat panel 3. FIG. 2 schematically shows the frame 6 and the shadow mask 5. The shadow mask 5, only part of which is shown in FIG. 2, is fixed to the frame 6 by any appropriate method such as a resistance welding method or a laser welding method. The use of the mask spring 12 for securing the frame 6 to the glass wall 9 makes it easy to repeat the removal/mounting of the frame 6 and the shadow mask 5 from/to the glass wall 9.

In this example, the frame 6 tightly supports the shadow mask 5 so as to give the shadow mask 5 a large tensile stress. Being given a large tensile stress during the manufacturing process, the shadow mask 5 is then free from deformation due to thermal expansion even when it is heated.

In general, the shadow mask 5 is heated up to approximately 100° C. by absorbing electron beams radiated from the electron gun. The tensile stress to be given to the shadow mask 5 is appropriately determined so that the shadow mask 5 will not be deformed at such a high temperature. In practice, the tensile stress is preferably in the range of 5 to 50 $kg/mm^2$. In this example, it was set to approximately 10 $kg/mm^2$.

The shadow mask 5 in the present invention can be tightened as described above, because it is flat in shape. Obviously, a curved shadow mask as in the prior art cannot be given such tensile stress without changing the designed curved shape.

A phosphor screen 7 is formed on the inner surface of the flat panel 3 for color display. The flat shadow mask 5 faces the inner surface of the flat panel 3 substantially in parallel therewith. In order to prevent deterioration of images due to a change in the color tone, the distance between the shadow mask 5 and the flat panel 3 (precisely, the phosphor screen 7) is preferably adjusted to a value in the range of approximately 5 to 30 mm. In this example, the distance between the shadow mask 5 and the flat panel 3 is approximately 10 mm, which will not change due to thermal expansion of the shadow mask 5.

The phosphor screen 7 is typically formed by the following process. A phosphor material is applied to the inner surface of the flat panel 3, and then irradiated with light through the shadow mask 5 so as to form a desired pattern on the phosphor material. Then, portions of the phosphor material are removed by developing, fixing and washing steps so as to obtain the phosphor screen 7 having the desired pattern.

In order to effectively conduct the formation of the phosphor screen 7, it is desirable to remove the shadow mask 5, which is fixed in the pattern formation step, in the developing, fixing and washing steps. As described earlier, according to the present invention, the frame 6 and the shadow mask 5 can be easily removed from the glass wall 9 and mounted again thereto. This improves the efficiency in the formation of the phosphor screen 7.

Furthermore, since the shadow mask 5 is flat in shape, the thickness of the shadow mask 5 can be reduced. As a result, the pitch of the apertures formed on the shadow mask 5 can also be reduced, making it possible to obtain images with high resolution. In consideration of the above, the thickness of the shadow mask 5 is preferably in the range of 0.01 to 0.2 mm. In this example, it was set to 0.02 mm. As a result, the pitch of the apertures was set to 0.25 mm and the diameter of the apertures 0.1 mm.

The flat panel 3, or at least a portion thereof where the phosphor screen 7 is formed on the inner surface, has a substantially uniform thickness, so that there is no difference between the intensity of the transmitting light in the center portion of the flat panel 3 and that obtained in the peripheral portion thereof. As a result, neither distortion nor nonuniform luminance distribution is produced over the image formed on the phosphor screen 7 when observed from the outside. In order to obtain high-quality images, the thickness of the flat panel 3 is preferably in the range of 5 to 20 mm. In this example, it was set to 10 mm.

Figure 3:
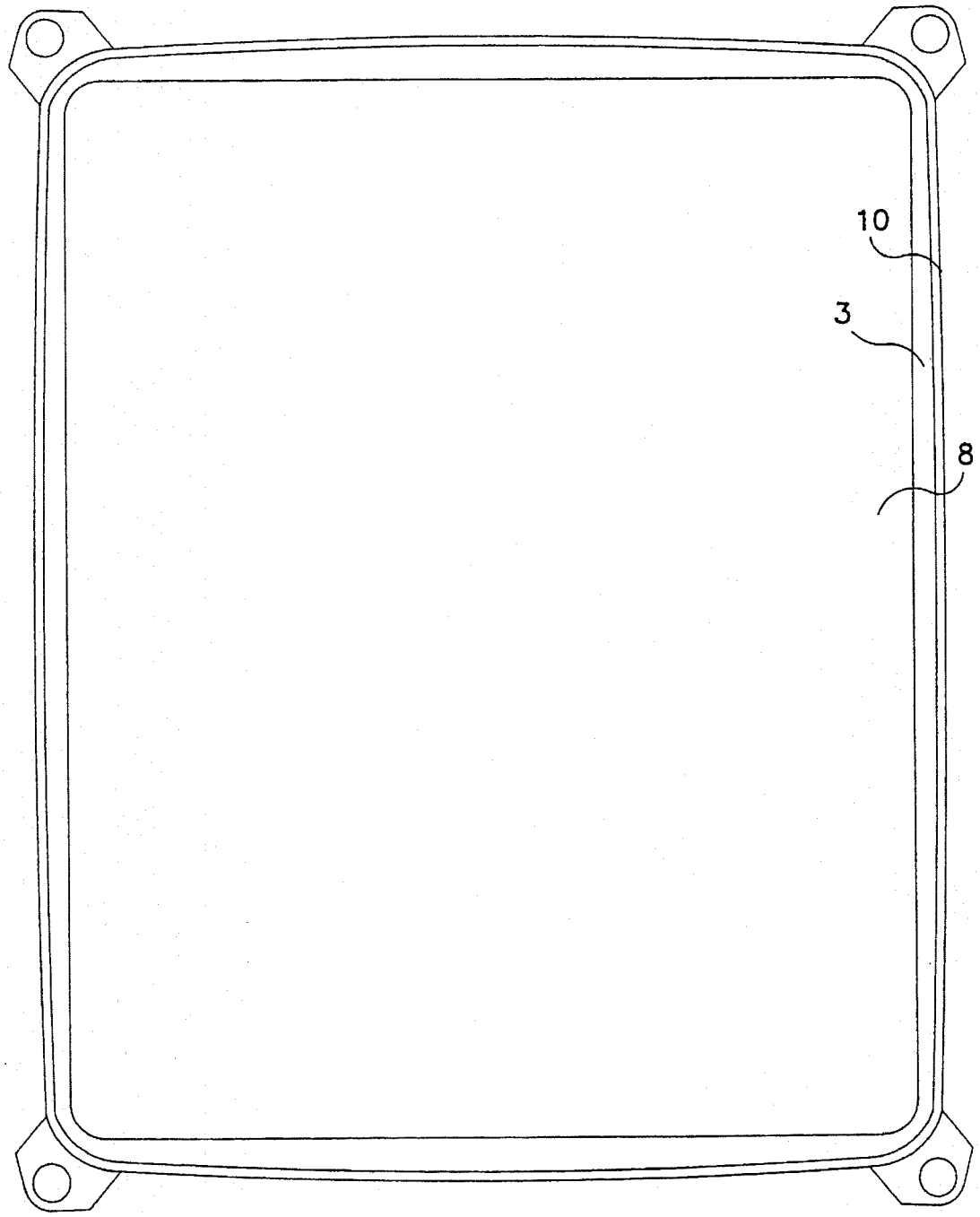
FIG. 3 is a front view of the color CRT according to the present invention, showing the attachment of a resin film to the surface of a flat panel.

In this example, a resin film 8 is attached to the outer surface of the flat panel 3. FIG. 3 is a front view of the flat panel 3 schematically showing the size and the shape of the resin film 8 attached thereto. As is evident from FIG. 3, the resin film 8 is so sized and shaped as to cover substantially the entire outer surface of the flat panel 3.

Forming a resin film on the front surface of the bulb of a color CRT has been previously tried. However, the purpose of such a previous trial was to prevent glass from scattering with a possible break of the bulb. Since attaching a resin film to a curved panel is difficult, a technique for attaching a resin film to a curved panel has not been made for practical use.

The resin film 8 of the present invention plays important roles as follows:

(1) Increase in strength:

The resin film 8 formed on the front surface of the bulb 11 can work, for example, as a shock absorber against a shock applied from the outside. Accordingly, the strength of the bulb 11 is substantially increased. This allows the flat panel 3 to be made thinner. With the thinner flat panel 3, the problems entailed by conventional thick flat panels such as the distortion of images, the non-uniformity in the luminance distribution due to the difference in the light transmittance, and the increase in weight Of the resultant color CRT can be solved. As a result, with the resin film 8, a flat panel sufficiently satisfying the requirements for practical application can be realized. Obviously, the resin film 8 of this invention can also provide the conventional effect of preventing glass from scattering with a break of the bulb.

(2) Improvement in scratch resistance and wear resistance:

The surface of the resin film 8 tends to produce microscopic damages by having dust thereon or being wiped with a cloth. Such damages caused by wearing and scratching can be reduced by hardening the surface of the resin film 8 by an appropriate surface treatment. By this hardening, the change in the optical characteristics due to the existence of microscopic damages on the surface of the flat panel 3 can be avoided, and thus the deterioration of images can be prevented. The aesthetic effect of providing a surface without damages can also be obtained.

(3) Prevention of reflection of light:

Images produced on the phosphor screen 7 on the inner surface of the flat panel 3 may become less visible for the viewers when light incident to the flat panel 3 from the outside is reflected therefrom. This reflection of the incident light can be minimized by forming minute concave and convex portions on the surface of the resin film 8, forming an additional film or conducting a surface reforming treatment on the surface of the resin film 8 for properly controlling the refractive index of the resin film 8. Thus, the visibility of the images can be improved.

(4) Prevention of electrification:

During the operation of the color CRT, the phosphor screen 7 formed on the inner surface of the flat panel 3 is illuminated with the electron beams emitted from the electron gun. This may electrify the flat panel 3 typically to a level of 30 kV. Such electrification can be avoided by providing the resin film 8 with an appropriate electrical conductivity. By this measure, the user's uneasiness at the operation or an accident which may be caused by discharge from such an electrified flat panel 3 can be prevented.

(5) Adjustment of light transmittance:

The flat panel 3 should be transparent enough to permit images produced on the phosphor screen 7 to be seen from the outside. However, in order to improve contrast of the image, the light transmittance of the flat panel 3 should be small. It is important therefore for the flat panel 3 to have an appropriate light transmittance. In a conventional color CRT without a resin film, the manufacturing conditions are controlled during the manufacturing process of the bulbs so as to obtain an appropriate light transmittance, typically in the range of 40 to 90%. However, precise control of the light transmittance is impossible by this conventional method.

According to the present invention, by using the resin film 8 with additives diffused therein to obtain an appropriate light transmittance, it is possible to substantially and easily control the light transmittance of the flat panel 3. Furthermore, it is possible to easily adjust the light transmittance of the resin film 8 so as to compensate for deviation of the light transmittance of the flat panel 3 which may occur when the manufacturing conditions in the manufacturing process of the bulbs change. Thus, substantial deviation of the light transmittance can be minimized, and as a result the manufacturing yield can be improved.

(6) Combined effects:

The flat panel 3 should preferably be given the above mentioned properties regardless of the formation of the resin film 8. However, in the case of a color CRT without the resin film 8, in order to obtain all of the desired properties, the manufacturing conditions must be intensely controlled in the manufacturing process of the bulbs 11. This control is extremely complicated and requires much labor. Similarly, using a single-layer resin film to realize all of the above properties is sometimes inconvenient because it tends to be difficult to adjust the composition of the resin and the conditions for forming the resin film. The above inconvenience can be solved by forming, as the resin film 8, a plurality of resin films or a resin film having a multilayer structure in which a plurality of layers having different properties are formed. In the resin film 8 having a multilayer structure (hereinafter referred to as a multilayer resin film), the layers, each of which has one of the above mentioned properties, are stacked so as to provide all of the above properties combined as a whole.

Figure 4:
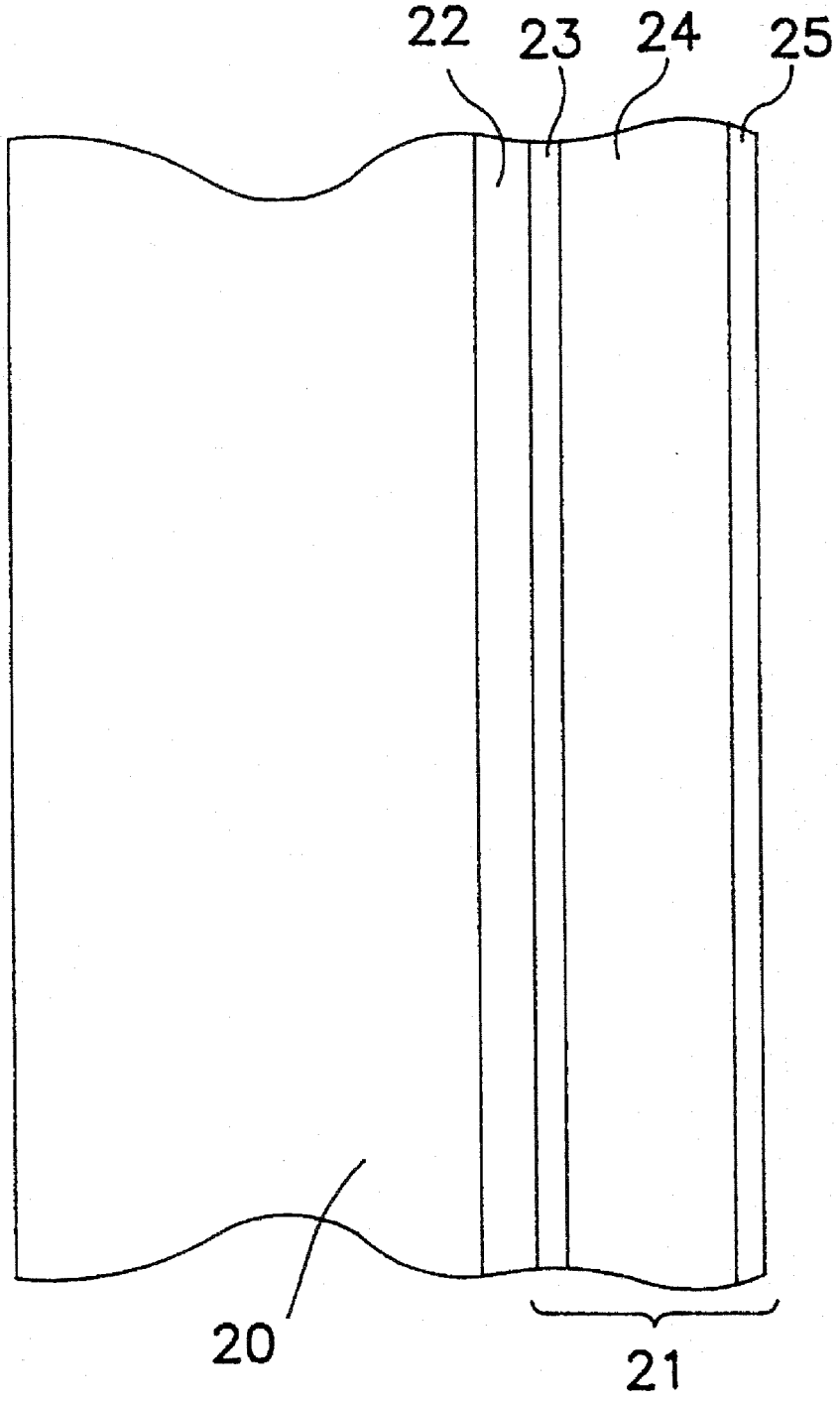
FIG. 4 is a schematic sectional view of a multilayer resin film according to the present invention.

FIG. 4 schematically shows a section of a multilayer resin film 21 as described above. The multilayer resin film 21 is attached to a glass plate 20 of the flat panel 3 by means of an adhesive An acrylic pressure sensitive adhesive, for example, may be used as the adhesive 22. The "pressure sensitive adhesive" as used herein refers to an adhesive which spreads over a surface by viscous flow when a pressure is applied thereto and then sticks to the surface after the pressure is removed. The pressure sensitive adhesive has such an appropriate viscosity that it can be easily stuck to the surface with the application of a small pressure. By using such an pressure sensitive adhesive, the resin film can be effectively attached to the glass plate 20. It also has such an appropriate elasticity that it is durable to an outer force such as peeling and shifting. The acrylic pressure sensitive adhesive is especially excellent in durability and heat resistance. Moreover, this adhesive is so durable for a long period of time that no undesired effect on the quality of the images is brought by the deterioration of the adhesive 22 even when the color CRT is used for a long time.

The multilayer resin film 21 includes a resin sheet 24 as a core layer thereof. In this example shown in FIG. 4, the resin sheet 24 is made of polyethylene terephthalate (PET) because it has excellent properties in transparency, mechanical strength, antilight capability and heat resistance capability. Other materials which can satisfy the above requirement can also be used for the resin sheet 24. For example, a sheet made of polystyrene, polyester or polyethylene can be used.

As shown in FIG. 4, the multilayer resin film 21 also includes a conductive layer 23 as the innermost layer thereof. The conductive layer 23 in this example is formed by attaching conductive powdery tin dioxide ($SnO_2$) to the resin sheet 24 by means of an adhesive made of silicon dioxide ($SiO_2$). In order to obtain a suitable effect for preventing electrification, the conductive layer 23 preferably has an electrical conductivity in the range from $1\times10^{-6}$ to 1 S/cm. The method for forming the conductive layer 23, the position of the conductive layer 23, and the component material thereof are not limited to those described above, but others can be selected as far as the above level of electrical conductivity can be obtained. For example, the conductive film made of tin dioxide may be coated or deposited on the resin sheet 24.

In order to prevent damages on the surface caused by scratching and wearing, it is preferable for the resin sheet 24 to have a surface hardness in the range of "H" to "9H" in pencil hardness. The pencil hardness is determined by a Kohinoor test in which a sample surface is scratched by a set of pencils having different hardness. More specifically, the sample surface is scratched five times respectively with each of the pencils having a different hardness. When the surface is damaged less than two out of five trials of scratching with the pencil having a specific hardness, the hardness of that pencil is considered as the pencil hardness of the sample surface. The details of pencil hardness is described in Japanese Industrial Standard (JIS) Nos. K5400 and K5401.

In order to obtain the pencil hardness in the above preferable range, a high-hardness film 25 is formed on the outer surface of the resin sheet 24. In this example, the high-hardness film 25 is formed as follows. A thin film made of a polymer having a siloxane bonding, which resembles the molecular skeleton of glass, is formed on the surface of the resin sheet 24 by a silicone hardcoating method. This provides the surface with a glass-like nature and thus high hardness can be obtained. More specifically, a material containing an alkoxysilane-group composition such as alkyltrialkoxysilane, a material containing alkyltrialkoxysilane mixed with colloidal silica, or the material further containing a silane coupling agent is applied to the resin sheet 24. Then, the material is dried and heated to allow the alkoxysilane to be hydrolyzed and polymerized so as to form the high-hardness film 25. In this example, the hydrolysate of alkyltrialkoxysilane mixed with colloidal silica was used in consideration of hardness and durability.

By forming the high-hardness film 25 made of the above material, the hardness of the surface of the resin sheet 24 can be increased without lowering the light transmittance. As a result, damages on the surface face caused by wearing and scratching can be prevented.

In addition, the high-hardness film 25 of this example can also work as a non-reflection film by forming the appropriate concave and convex portions on the surface thereof. Accordingly, the reflectance at the surface of the flat panel can be easily set to a value in a preferable range, so that images produced on the phosphor screen 7 are prevented from becoming less visible by being disturbed by light incident to the surface of the flat panel from the outside and reflected therefrom. The preferable range of the reflectance at the surface of the flat panel 3 is 1 to 95%.

The methods for obtaining the above range of surface hardness and reflectance are not limited to the methods and materials described above, but other surface reforming methods are also possible. For example, the surface of the resin sheet 24 may be subjected to a surface reforming treatment for increasing the surface hardness. Then, concave and convex portions may be formed on the treated surface so that a preferable reflectance can be obtained. Alternatively, the thickness of the high-hardness film having a hardness in the preferable range can be controlled so as to have an appropriate value of the thickness for functioning as the non-reflection film. Also, it is possible for the multilayer resin film to have a film which functions as the non-reflection film and another film which functions as the high-hardness film.

In order to control the light transmittance of the multilayer resin film 21 so as to obtain an appropriate light transmittance of the flat panel 3 as a whole, some additives may be diffused in the resin sheet 24. Thus, the scattering and/or absorbing effect of light by the additives can be utilized for the above purpose. The diffused condition of the additives can be properly adjusted so as to obtain a preferable light transmittance. The preferable light transmittance as the total of the multilayer resin film 21 and the flat panel 3 is in the range of 40 to 90%, where the images produced on the phosphor screen 7 can be clearly seen from the outside with the improved contrast, but the inner structure of the bulb is not seen unnecessarily.

In this example, a black dye is used as the additive. Specifically, Spirit Black (C.I. Name: Solvent Black 5), Threne Grey 3B (C.I. Name: Vat Black 16) and the like are used.

The total thickness of the multilayer resin film 21 having the above described structure is typically about 0.1 mm. The thicknesses of the respective layers can be set as follows: 0.01 mm for the adhesive 22; 0.01 mm for the conductive layer 23; 0.07 mm for the resin sheet 24; and 0.01 mm for the high-hardness film 25.

Materials for the respective layers are not limited to those described above, but any other suitable materials may be used insofar as the desired properties can be obtained. In addition, the multilayer resin film 21 may include other films which bring other properties to the flat panel 3.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A color cathode ray tube comprising:

a bulb having a flat glass panel, the flat glass panel having a predetermined thickness which is substantially uniform in the range from 5 mm to 20 mm and including a glass wall formed integrally as a part of the flat glass panel, the glass wall extending in a substantially vertical direction from the flat glass panel;

a flat shadow mask provided inside the bulb, the flat shadow mask facing the flat glass panel; and a frame attached to the glass wall and provided inside the bulb, the frame supporting the flat shadow mask and giving the flat shadow mask tensile stress in a range from 49 newtons/mm$^2$ to 490 newtons/mm$^2$ at least at room temperature, wherein a resin film comprising at least one layer is attached to the outer surface of the flat glass panel for preventing implosion of the color cathode ray tube.

2. A color cathode ray tube according to claim 1, wherein the frame is attached so as to be capable of being repeatedly removed and mounted from/to the glass wall.

3. A color cathode ray tube according to claim 1, wherein the thickness of the flat shadow mask is set in a range of 0.01 mm to 0.2 mm.

4. A color cathode ray tube according to claim 1, wherein at least one layer of the resin film functions as a conductive layer which has a sufficient level of electrical conductivity so as to prevent the flat glass panel from being electrified.

5. A color cathode ray tube according to claim 4, wherein the conductive layer has an electrical resistivity which is in a range frown (1/2.54) Ω-inch to (1/2.54)×10$^6$ Ω-inch.

6. A color cathode ray tube according to claim 1, wherein at least one layer of the resin film is diffused with additives so as to control light transmittance of the flat glass panel and the resin film.

7. A color cathode ray tube according to claim 6, wherein a light transmittance of the resin film is adjusted so that the light transmittance of the flat glass panel and the resin film as a whole is in a range from 40% to 90%.

8. A color cathode ray tube according to claim 1, wherein at least one layer of the resin film is a non-reflection layer for preventing the reflection of light incident from the outside of the bulb.

9. A color cathode ray tube according to claim 8, wherein a light reflectance of the surface of the resin film is set to be in a range from 1% to 95%.

10. A color cathode ray tube according to claim 1, wherein on a surface of the resin film, convex and concave portions are formed so as to prevent the reflection of light incident from the outside of the bulb.

11. A color cathode ray tube according to claim 10, wherein a light reflectance of the surface of the resin film is set to be in a range from 1% to 95%.

12. A color cathode ray tube according to claim 1, wherein a surface of the resin film is reformed so as to increase a hardness of the surface of the resin film.

13. A color cathode ray tube according to claim 12, wherein the hardness of the surface of the resin film is set to be in a range from H to 9H in pencil hardness.

14. A color cathode ray tube according to claim 1, wherein on a surface of the resin film, a high-hardness film having a higher hardness than that of other portions of the resin film is formed so as to increase a hardness of the surface of the resin film.

15. A color cathode ray tube according to claim 14, wherein the hardness of the surface of the resin film is set to be in a range from H to 9H in pencil hardness.

16. A color cathode ray tube according to claim 1, further comprising a reinforcing band surrounding the circumference of the glass wall of the bulb.

17. A color cathode ray tube according to claim 1, wherein at least one layer of the resin film is made of a material selected from a group consisting of polyethylene, polyethylene terephthalate, polystyrene and polyester.

18. A color cathode ray tube according to claim 1, wherein the resin film comprises:

a resin sheet in which additives are diffused;

a non-reflection film formed on a surface of the resin sheet so as to prevent the reflection of light incident from the outside of the bulb; and a conductive film formed on the other surface of the resin sheet, the conductive film having a sufficient level of an electrical conductivity so as to prevent the flat glass panel from being electrified, and wherein the resin film is attached to the flat glass panel by an adhesive applied on the conductive film.

19. A color cathode ray tube according to claim 1, wherein the resin film comprises:

a resin sheet in which additives are diffused;

a high-hardness film having a higher hardness than that of the resin sheet, the high-hardness film formed on a surface of the resin sheet so as to increase a hardness of the surface of the resin sheet, the high-hardness film having convex and concave portions formed on a surface thereof so as to prevent the reflection of light incident from the outside of the bulb; and a conductive film formed on the other surface of the resin sheet, the conductive film having a sufficient level of an electrical conductivity so as to prevent the flat glass panel from being electrified, and wherein the resin film is attached to the flat glass panel by an adhesive applied on the conductive film.

* * * * *

UNITED STATES PATENT AND TRADEMARK OFFICE

CERTIFICATE OF CORRECTION

PATENT NO. : 5,532,545
DATED : July 2, 1996
INVENTOR(S) : Okamoto et al.

It is certified that error appears in the above-indentified patent and that said Letters Patent is hereby corrected as shown below:

Column 4, line 50, the hyphen between "the" and "glass" should be deleted.

Column 5, line 56, "nonuni-" should be --non-uni- --.

Column 7, line 35, after "adhesive" insert --22.--.

Column 8, line 43, delete the word "face"

Column 10, line 5, "frown" should be --from--.

Signed and Sealed this

Twenty-first Day of January, 1997

*Attest:*

*Attesting Officer*

BRUCE LEHMAN

*Commissioner of Patents and Trademarks*